United States Patent [19]

Ganon

[11] Patent Number: 4,899,412

[45] Date of Patent: Feb. 13, 1990

[54] SLIPPER AND METHOD OF MAKING SAME

[75] Inventor: Michael H. Ganon, Bexley, Ohio

[73] Assignee: R. G. Barry Corporation, Pickerington, Ohio

[21] Appl. No.: 241,312

[22] Filed: Sep. 7, 1988

[51] Int. Cl.[4] ..... A43B 10/00; A43B 1/02; A43B 3/10

[52] U.S. Cl. ..... 12/142 A; 12/142 G; 12/142 S; 36/9 R; 36/12

[58] Field of Search ..... 12/142 R, 142 A, 142 G, 12/142 S, 142 T; 36/9 R, 12, 19 R, 19 A, 21

[56] References Cited

U.S. PATENT DOCUMENTS

| | | | |
|---|---|---|---|
| 434,975 | 8/1890 | Blum | 12/142 G |
| 1,027,249 | 5/1912 | Hale | 36/9 R |
| 1,194,467 | 8/1916 | Bickford | 12/142 R |
| 1,201,927 | 10/1916 | Blum | 12/142 R |
| 1,262,026 | 4/1918 | Dillberg | 12/142 G |
| 1,291,958 | 1/1919 | Lund | 36/9 R |
| 1,640,362 | 8/1927 | Mahler et al. | 12/142 G |
| 1,754,272 | 4/1930 | Jorgensen | 12/142 R |
| 2,466,637 | 4/1949 | Carson | 12/142 S |
| 3,015,171 | 1/1962 | Kaplan | 36/9 R |
| 3,063,074 | 11/1962 | Scholl | 12/142 G |
| 3,199,132 | 8/1965 | Newman | 12/142 R |
| 3,228,050 | 1/1966 | Wall | 12/142 R |
| 3,345,762 | 10/1967 | Fischer et al. | 36/9 R |
| 3,408,751 | 11/1968 | Levy | 36/12 X |
| 3,423,854 | 1/1969 | Snow | 12/142 R |
| 3,491,390 | 1/1970 | Greenblatt et al. | 12/142 R |

FOREIGN PATENT DOCUMENTS

| | | | |
|---|---|---|---|
| 143507 | 11/1935 | Austria | 12/142 A |
| 2184233 | 11/1973 | France | 36/9 R |
| 563158 | 5/1957 | Italy | 12/142 S |

*Primary Examiner*—James Kee Chi

*Attorney, Agent, or Firm*—Watson, Cole, Grindle & Watson

[57] ABSTRACT

Toe portions of an outsole and an outsole pad are stitched together, the outsole having a longitudinally extending slit formed therethrough. A vamp is then stitched to the toe portions of the outsole with the vamp and outsole inside out from their position in a finished slipper. The vamp and outside are then stitched to a sock at the toe portions thereof and a portion of the outsole pad is pulled through the opening in the outsole. The outsole and vamp are then stitched completely to the sock. The slipper is then turned to its right side through the opening in the outsole. The opening is closed with tape, and the portions of the outsole and outsole pad rearwardly of the stitched portions thereof are adhesively secured together.

22 Claims, 9 Drawing Sheets

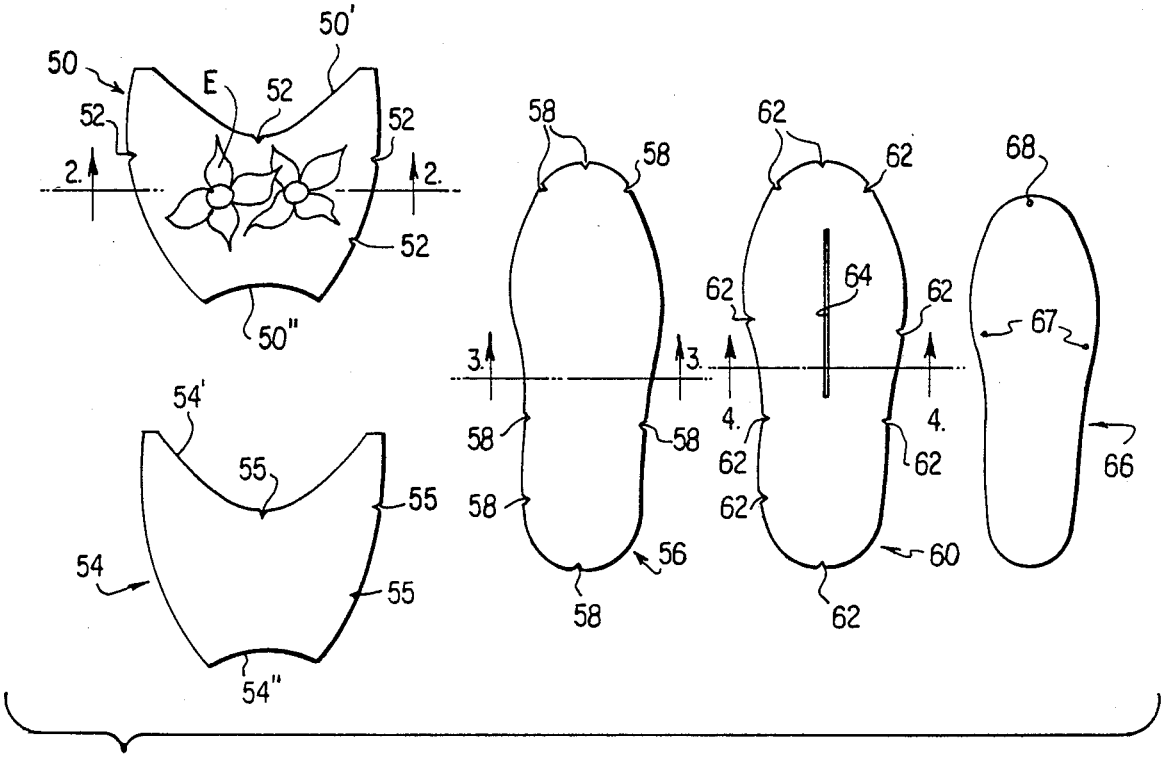
FIG. 1
FIG. 2
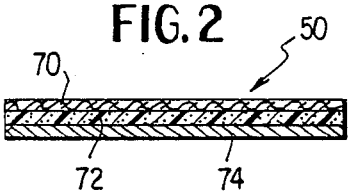
FIG. 3
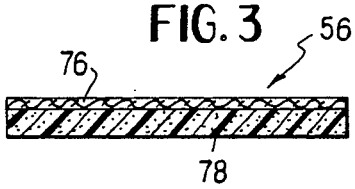
FIG. 4
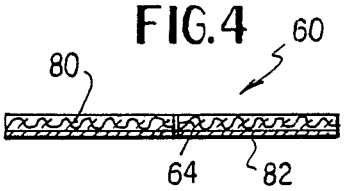
FIG. 5
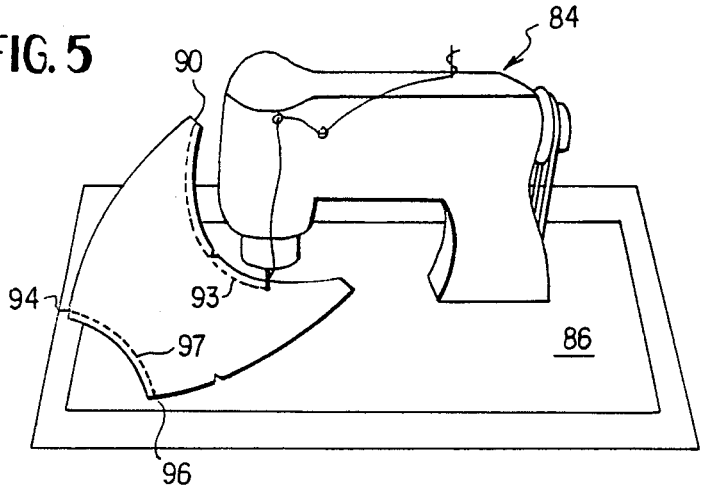
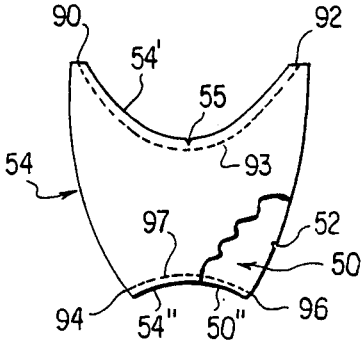
FIG. 6

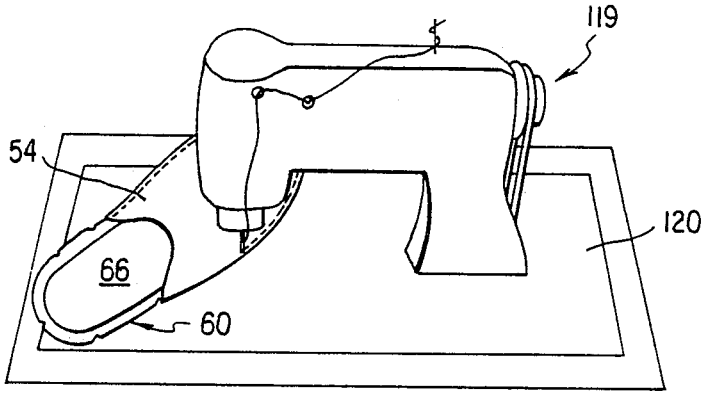
FIG. 11
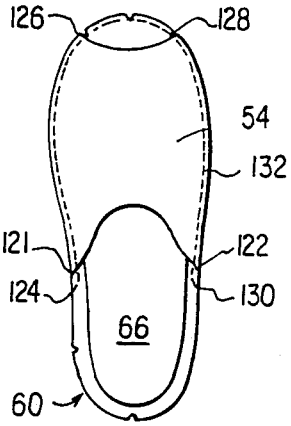
FIG. 12
FIG. 13
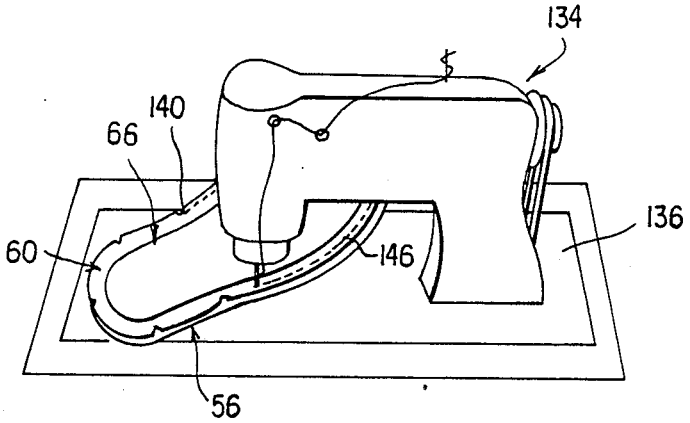
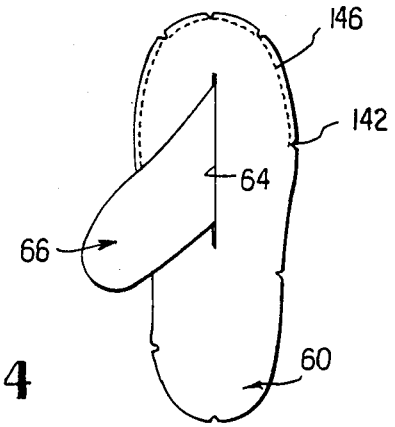
FIG. 14
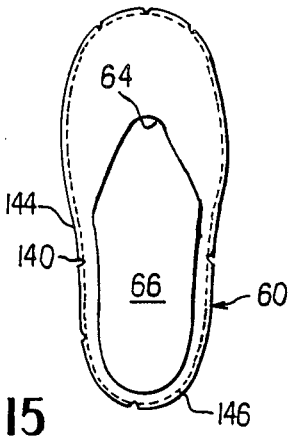
FIG. 15

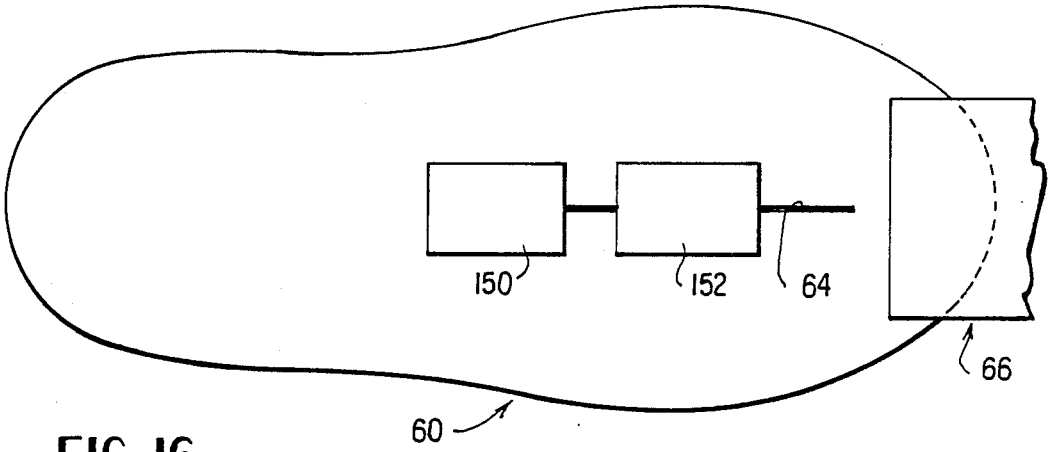
FIG. 16
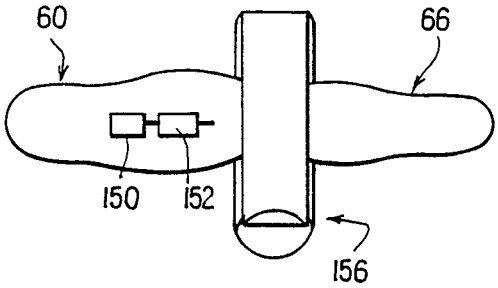
FIG. 17
FIG. 18
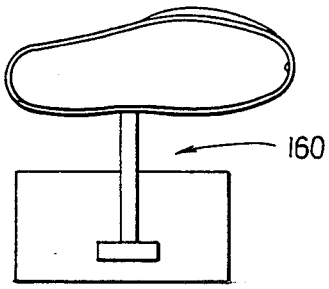
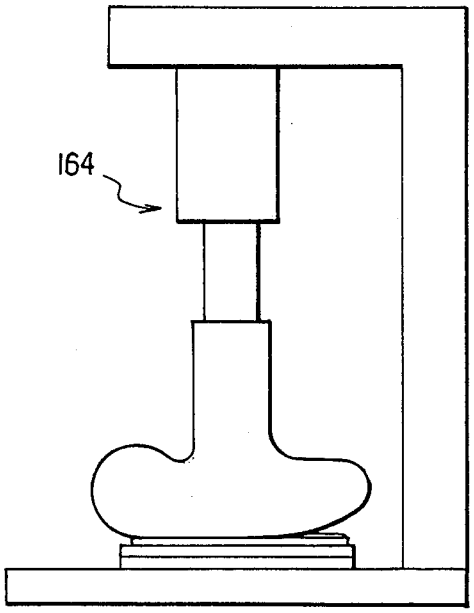
FIG. 19

FIG. 20
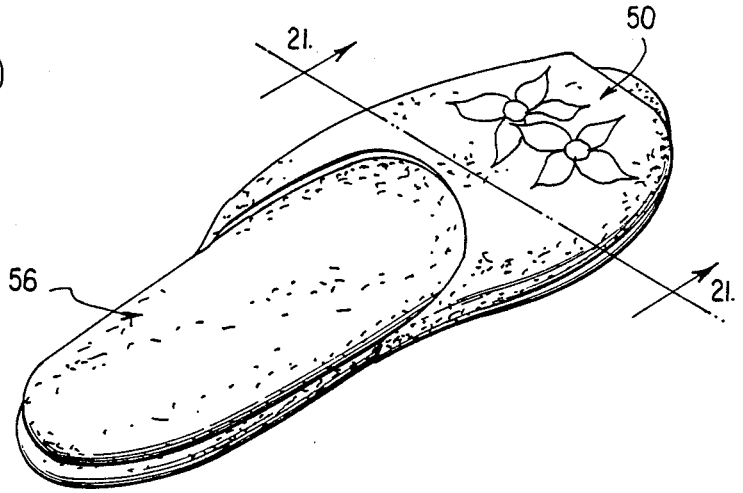
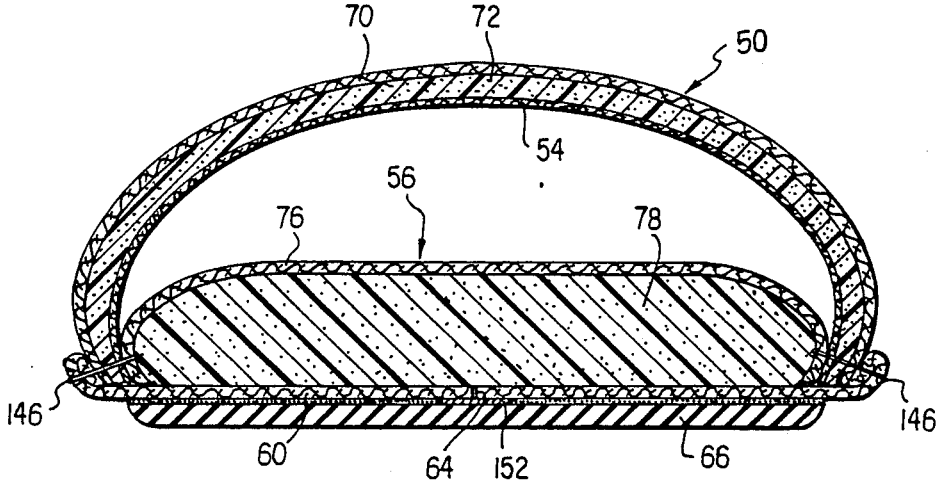
FIG. 21

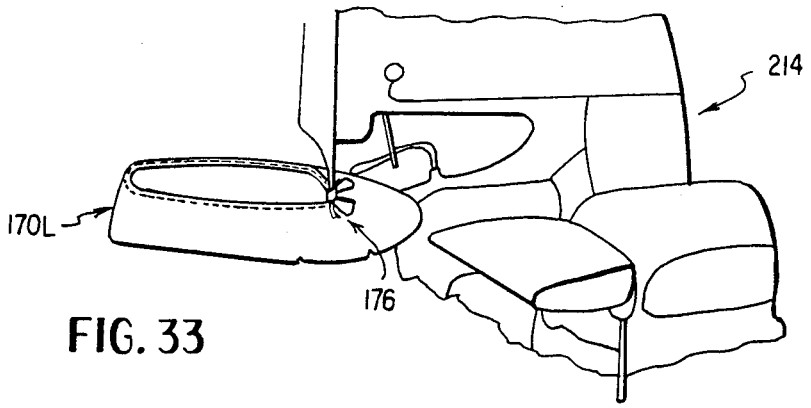
FIG. 33
FIG. 34
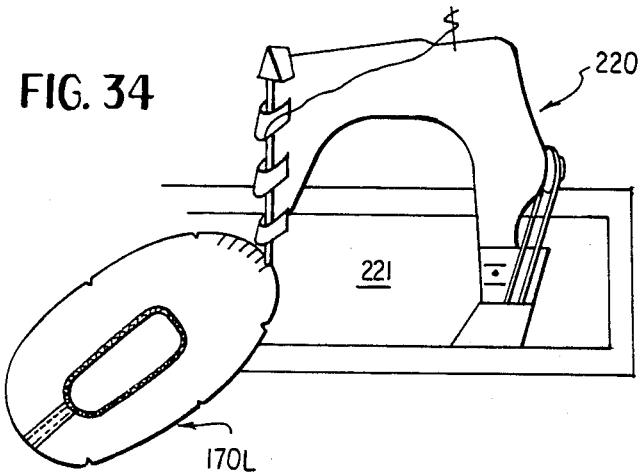
FIG. 35
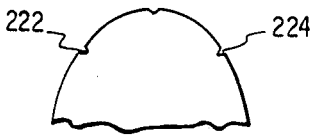
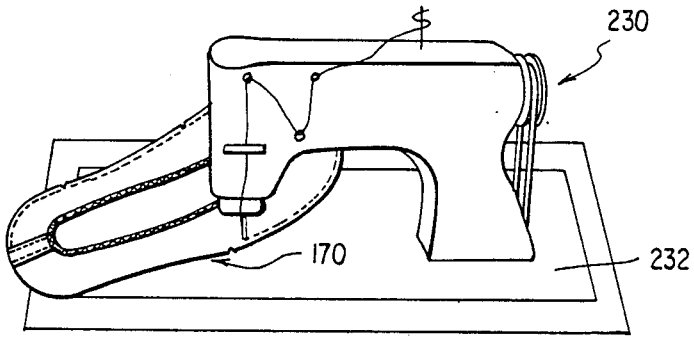
FIG. 36
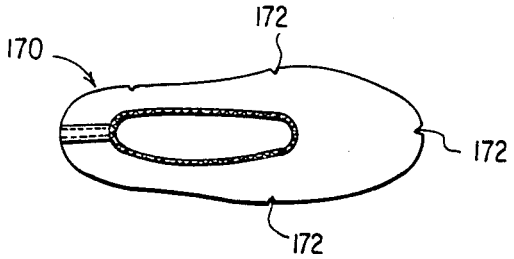
FIG. 37

SLIPPER AND METHOD OF MAKING SAME

BACKGROUND OF THE INVENTION

The present invention relates to slippers, and more particularly to slippers of the scuff or ballerina type.

In the prior art, slippers of this type have employed a wrap which comprises a strip of material extending around the sole of the slipper. The wrap is pulled down by a side laster machine. The use of a stiffener such as a relatively rigid board is required in such slippers to enable the wrap to be properly pulled down. The stiffener causes the finished slipper to be stiff and difficult to flex and also results in an unattractive square or boxy look. Furthermore, when the wrap is pulled down, it compresses the cushioning material of the slipper, resulting in a reduced cushioning effect in use and a flattened appearance when not in use.

Such prior art constructions also incorporate the undesirable feature of a vertical seam disposed on the sole of the slipper adjacent the instep. Additionally, binding is used to cover some seams, and this binding makes the slipper appear to be wider than it actually is.

SUMMARY OF THE INVENTION

The present invention overcomes the disadvantages of known slippers by providing a novel arrangement wherein the use of a wrap is eliminated. No lasting or binding is required, and there is no need to employ a stiffener or nonflexible board. The finished slipper is soft and flexible and presents a rounded rather than a square or boxy look. The cushioning material is not compressed during manufacture, and accordingly, a greater cushioning effect is obtained and the foot supporting portion of the slipper has a desirable puffy look.

The finished slipper has no unfinished edges or vertical seams, and since no binding is utilized, the slipper has a more finished or sleek appearance and readily conforms to the shape of the foot.

The above advantages of the invention slipper are obtained by making the slipper according to a unique method wherein an outsole has an elongated opening or slit formed therethrough and an outsole pad initially has a portion thereof attached to the outsole. A vamp and a sock are attached to the outsole, and the outsole pad is pulled through the outsole opening. The toe and heel portion of the slipper are turned through the outsole opening, and then a further portion of the outsole pad is attached to the outsole to secure the slipper components in finished position.

BRIEF DESCRIPTION OF THE DRAWINGS

FIGS. 1–19 illustrate the method of making a scuff type of slipper;

. FIG. 20 is a top perspective view of a finished slipper according to the present invention;

FIG. 21 is a cross-sectional view on an enlarged scale taken along lines 21—21 of FIG. 16, looking in the direction of the arrows; and FIGS. 22–37 illustrate the method of making a ballerina type of slipper.

DESCRIPTION OF THE PREFERRED EMBODIMENTS

Figure 7:
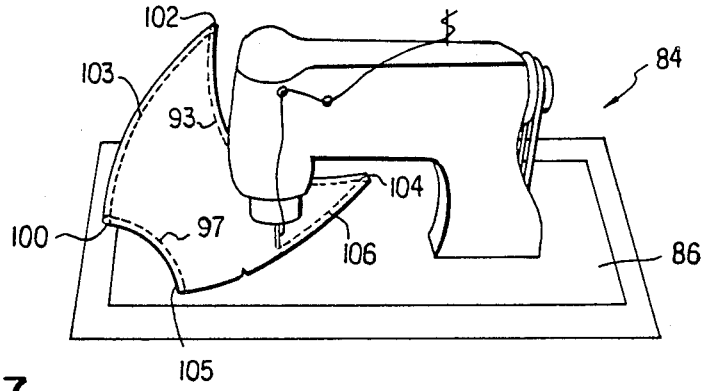

As used throughout the description, the term "right side" denotes the surface of a component which faces outwardly of the slipper and which is viewed by an observer. The term "wrong side" denotes the surface of a component which faces inwardly of the slipper and which is normally not seen by an observer.

Furthermore, it will be understood that some of the components of the slippers will be slightly different for the right and left foot slippers as is well-known in the art. The methods of making the right and left slippers are substantially the same except where indicated.

Referring now to the drawings wherein like reference characters designate corresponding parts throughout the several views, FIG. 1 illustrates the components from which a scuff type of slipper is made. A vamp 50 has aligning notches 52 formed at spaced points about the periphery thereof, the vamp comprising three layers of material as hereinafter described. A vamp lining 54 has an outer configuration similar to that of the vamp and comprises cloth made of a cotton and polyester blend. Lining 54 has aligning notches 55 formed at spaced points about the periphery thereof.

A sock 56 has aligning notches 58 formed at spaced points about the periphery thereof and comprises two layers of material as hereinafter described. An outsole 60 also has aligning notches 62 formed at spaced points about the periphery thereof and comprises two layers of material as described below. The outsole has an elongated opening or slit 64 formed therethrough, the opening extending along the lengthwise dimension of the elongated outsole. The final component of this form of the invention comprises an outsole pad 66 which is formed of a suitable synthetic rubber or the like which is soft and flexible and which at the same time has good wearing qualities. The outsole pad is provided with a pair of side outnicks or aligning marks 67 and a center toe outnick 68.

Referring now to FIG. 2 of the drawings, vamp 50 includes a top layer 70 of conventional 100% cotton woven terrycloth, the upper surface or right side of which is the sheared side of the terrycloth, the lower surface or wrong side thereof being the loop side which faces downwardly toward a layer 72 of material such as polyether synthetic foam which makes the vamp puffy and soft. Layers 70 and 72 are attached or bonded to one another by a suitable adhesive material. A bottom layer 74 is formed of a thin tissue-like material such as Pellon, a product of Haskell Lining, Inc. of New York, N.Y. Layer 74 is attached to layer 72 by a suitable adhesive material. Layer 74 is provided in this embodiment to facilitate embroidering the vamp; and after the emboidery is completed, layer 74 is torn away and discarded. Layer 74 is the only component of the slipper which is not provided in both a right foot and left foot version. As shown in FIG. 1, vamp 50 has an embroidered design E disposed thereon. This embroidered design may be eliminated if desired, and in such a case, layer 74 may be eliminated from the vamp. The embroidering step is carried out with conventional equipment in the usual manner.

Referring now to FIG. 3 of the drawings, the sock 56 includes a top layer 76 of terrycloth, the upper surface or right side of the terrycloth being the sheared side thereof, and the lower surface or wrong side thereof being the loop side which faces and is adhesively attached to a layer 78 of cushioning material formed, for example, of one-half inch thick polyether synthetic foam.

Referring now to FIG. 4 of the drawings, the outsole includes a layer of terrycloth 80 which is adhesively attached to a thin layer 82 formed of Pellon. The upper surface or right side of layer 80 is the sheared side of the terrycloth, and the lower surface or wrong side of layer 80 is the loop side of the terrycloth.

Referring now to FIGS. 5 and 6 of the drawings, a conventional sewing machine 84 having a support surface 86 is employed for attaching the vamp to the vamp lining. The vamp is placed on the support surface with the right or sheared side of the vamp facing up. The lining is then placed with the right side thereof down on top of the vamp such that the right side of the vamp is in facing relationship to the right side of the vamp lining.

The throat edges 50' and 54' as well as the notches 52 and 55 of the vamp and vamp lining respectively are aligned with one another, and these components are attached to one another by sewing. The sewing is started at one throat point 90 and continues around the lining throat, maintaining the throat contour. The sewing continues to the opposite throat point 92 to form a line of stitching 93. The vamp and vamp lining are then repositioned with the toe edges 50" and 54" of the vamp and vamp lining aligned with one another. The sewing starts at one toe point 94 and continues to the opposite toe point 96 to form a line of stitching 97. FIG. 6 is partly broken away for the purpose of illustration.

Figure 8:
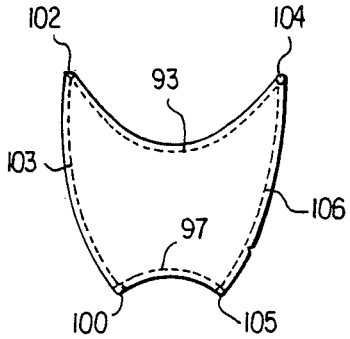

The vamp and vamp lining are then turned inside out so that the right sides of the two components face away from one another and are presented to view. Further portions of the vamp and vamp lining are then attached to one another. Referring now to FIG. 7, The vamp is then placed on the support surface of the machine with the lining side up. The vamp and vamp lining side edges are aligned. Sewing is then started at toe point 100 and a one-eighth inch seam is sewn to throat point 102 to form a line of stitching 103. The vamp is then repositioned on the machine with the lining side up and the opposite side toward the machine foot. Sewing is started at throat point 104 and continues to toe point 105, forming a line of stitching 106. FIG. 8 illustrates the amp and vamp lining in fully attached relationship.

Figure 9:
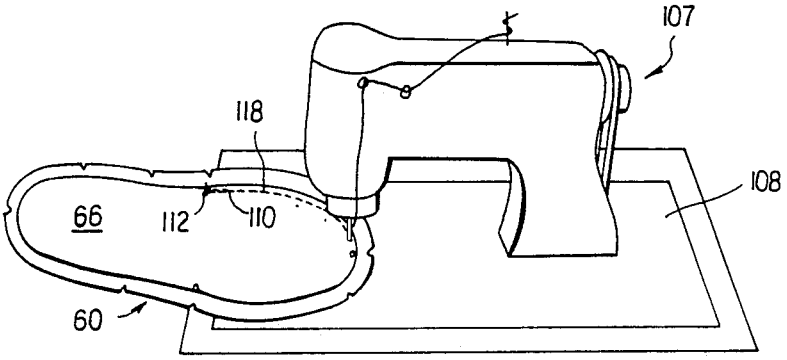
Figure 10:
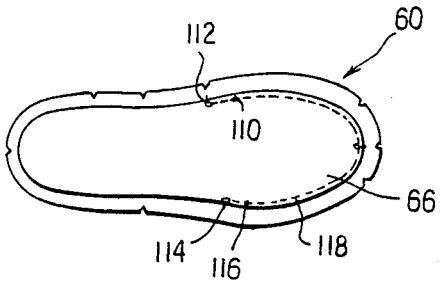

Referring now to FIGS. 9 and 10 of the drawings, a portion of the outsole is attached to a portion of the outsole pad. A conventional sewing machine 107 having a supporting surface 108 is employed. It should be understood that different machines may be employed for the various steps of the method, all of such machines being of well-known conventional construction.

Outsole 60 is placed on the machine with the right or sheared side of the outsole facing up. The outsole pad also includes a right side and a wrong side, the right side including suitable indicia thereon such as the size and a trademark or the like. The outsole pad 66 is then placed on top of the outsole with the right side up. Accordingly, the wrong side of the outsole pad is disposed in facing relationship to the right side of the outsole. The outsole pad is in covering relationship to the opening formed through the outsole and will be accessible through the opening as hereinafter explained.

The toe portions of the outsole and outsole pad are then attached to one another by sewing. The side outnicks in the outsole pad are aligned with corresponding side notches in the outsole, and the center toe outnick in the outsole pad is aligned with the toe notch in the outsole with equal margins side to side between the outsole and the outsole pad. Sewing is started at point 110 one-half inch in front of the outnick, and then is backtacked to the outnick in the outsole pad as indicated at 112. Sewing is then continued toward the toe, keeping the outsole pad in alignment with the outsole. The sewing continues around the toe to a point 114 at the outnick at the side of the outsole pad, and then is backtacked one-half inch to the point 116 thereby forming a line of stitching 118.

Referring now to FIGS. 11 and 12 of the drawings, a conventional sewing machine 119 is shown with a supporting surface 120. In this case, the machine may be a walking foot machine using a low walking motion. Outsole 60 is placed on the machine with the right side of the outsole and the right side of the outsole pad facing upwardly. The vamp is then placed on top of the outsole with the lining side up. Accordingly, the right side of the vamp is disposed in facing relationship to the right side of the outsole.

The vamp throat points 121 and 122 are aligned with the outsole side notches and sewing is started at point 124 approximately one inch in front of the throat point 121 and the sewing continues up on the vamp throat. The vamp toe points 126 and 128 are aligned with the outsole toe notches. The edges are aligned and the sewing continues around the toe and down on the vamp throat to a point 130 approximately one inch past throat point 122 thereby forming a line of stitching 132.

Referring now to FIGS. 13–15 of the drawings, a conventional sewing machine 134 is provided with a supporting surface 136. Sock 56 is placed on the machine with the right side or sheared terrycloth side up. The outsole and attached vamp are then placed on top of the sock with the right side of the outsole facing down. Accordingly, the right side of the sock is disposed in facing relationship to the right side of the outsole. The outsole side notch is aligned with the side notch of the sock. Sewing is then started at a point 140 which corresponds to the vamp throat point and continues toward the toe, thereby attaching both the outsole and the vamp to the sock. The toe notches of the outsole and sock are aligned, and the sewing continues around the toe. The opposite side edges of the outsole and sock are aligned, and the sewing continues to a point 142 approximately three inches from the toe notches thereby forming a line of stitching 146.

At this point, an operator reaches through the opening 64 and pulls a portion of the outsole pad through the opening as indicated in FIG. 14. Sewing then continues around the slipper, aligning the notches as one sews, to a point 144 about three-quarters of an inch beyond the starting point 140 as seen in FIG. 15. The outsole is now completely attached to the sock.

The slipper is then turned to its right side through opening 64. In other words, the vamp and outsole are inside out from finished position after attaching the outsole to the sock. The vamp and outsole are turned through opening 64 so as to be right side out whereby the right side of the vamp and the right side of the outsole face away from one another, while the right side of the sock faces in the same direction as the right side of the vamp. This turning can be done solely by hand, or with the aid of a conventional turning machine. For example, after attaching the outsole to the sock, an operator can reach through opening 64 and turn the toe to the right side. Then the heel can be turned to the right side.

Referring now to FIG. 16 of the drawings, the slipper is then turned upside down, and outsole pad 66 is folded upwardly as seen in this figure to gain access to opening 54. The opening is substantially closed and maintained substantially closed by first grasping hold of the outsole on both sides of the slit and pulling it substantially closed. A first piece of masking tape 150 is applied in spanning relation to the bottom of the opening adjacent the instep and a second piece of tape 152 is applied in spanning relation to the opening adjacent the ball of the foot portion of the outsole. Any suitable tape or holding means may be employed to hold the opening substantially closed, and a single piece of tape extending lengthwise of the opening and in spanning relation thereto may be employed instead of two separate pieces of tape if so desired.

After the opening is substantially closed, the outsole and the outsole pad which are attached at the toe portions thereof are passed through a conventional machine 156 as seen in FIG. 17 of the drawings which applies a thin layer of an adhesive such as urethane cement to the wrong side of outsole pad 66 and the right side of outsole 60. A suitable adhesive could also be applied by hand, but the use of a machine ensures a more uniform and effective coating of adhesive. The adhesive is then suitably heated as by passing the outsole and outsole pad through a heat tunnel with the adhesive side up.

Referring now to FIG. 18 of the drawings, The slipper is placed over a proper size conventional foot form indicated generally by reference numeral 160, and the outsole pad is aligned with the outsole to provide equal distance side to side and toe to heel. The spotted slipper is then passed to a suitable press as indicated by reference numeral 164 in FIG. 19, and pressure is applied to the slipper to cause the outsole pad to adhere to the outsole. Accordingly, the slipper is then secured in finished position by attaching further portions of the outsole pad to the outsole The finished slipper is shown in FIG. 20 of the drawings. As seen in FIG. 21, the finished slipper comprises an outsole 60 having upper and lower surfaces with an opening 64 therethrough. The outsole pad 66 is attached to the lower surface of the outsole and covers the opening. Sock 56 has peripheral portions thereof connected to peripheral portions of the outsole by stitching 146 which also connects the vamp 50 to the sock. The major part of the cloth portion of the sock is spaced from the outsole to define a space therebetween, and the cushioning material 78 of the sock substantially fills such space.

Figure 22:
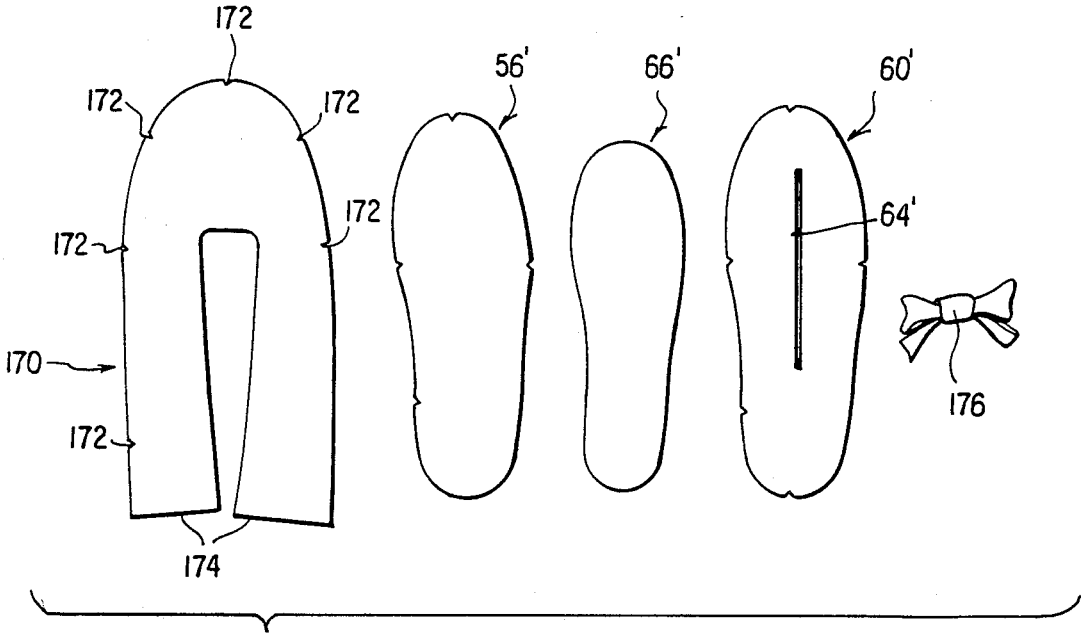

FIG. 22 of the drawings illustrates the components from which a ballerina type slipper is made. The vamp 170 is of generally U-shaped plan configuration and has opposite heel edges 174. The vamp is made of terrycloth, the loop side of the terrycloth being the right side, and the sheared side of the terrycloth being the wrong side. The vamp 170 is provided with aligning notches 172. A sock 56', an outsole pad 66' and an outsole 60' are each substantially identical to sock 56, outsole pad 66 and outsole 60 respectively which have been previously described, and therefore, no further description of these components is necessary. Trim in the form of a bow 176 is also provided.

Figure 23:
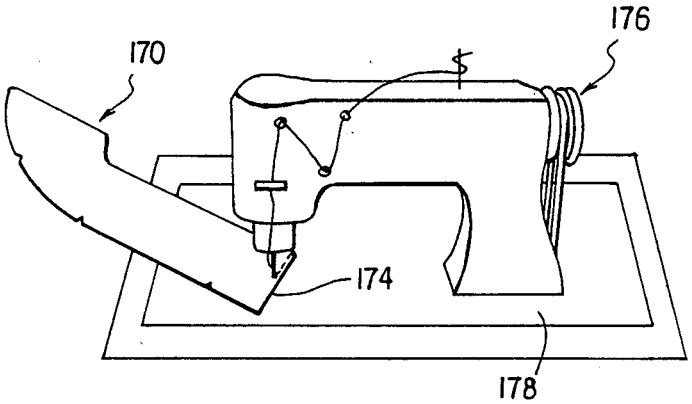
Figure 24:
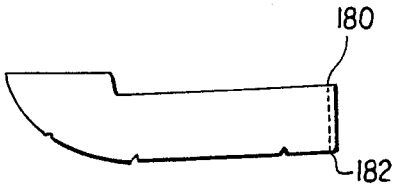
Figure 25:
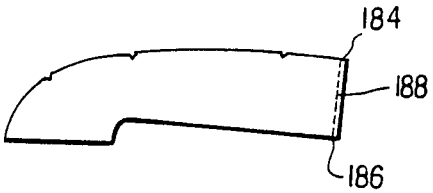

Referring now to FIG. 23 of the drawings, a conventional sewing machine 176 with supporting surface 178 is provided. Vamp 170 is folded in the middle thereof so that portions of the right or loop side of the vamp are disposed in facing relationship and opposite heel edges 174 are aligned with one another. The vamp is then placed under the sewing machine foot with the wrong or sheared side up. As seen in FIG. 24, sewing is started at point 180 at the top of the heel and continues to point 182 at the bottom of the heel. The vamp is then flipped over to the position shown in FIG. 25 and sewing is started at a point 184 at the bottom of the heel and continues to a point 186 at the top of the heel, whereby the heel is inseamed twice as indicated by reference character 188.

Figure 26:
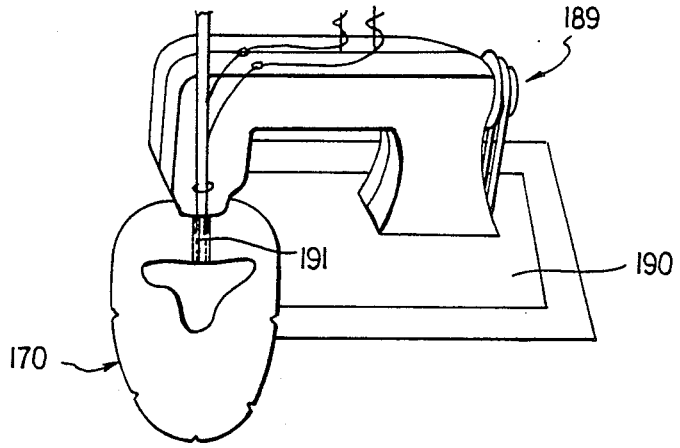
Figure 27:
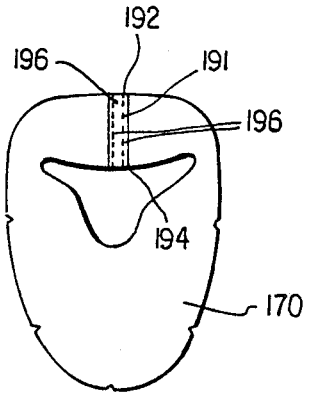

Referring now to FIG. 26 of the drawings, a conventional sewing machine 189 is provided with a support surface 190. In this case, the machine is a double needle machine set up with two needles. The vamp is placed wrong side up on the machine, and the heel seam is opened up so that the vamp assumes the shape illustrated. A piece of conventional heel tape 191 is provided, and in a typical example may be one and one-half inches long and bias cut. The tape is centered over the heel seam and sewing is started at point 192 as seen in FIG. 27 at the bottom of the heel and continues to a point 194 at the top of the heel, thereby forming a double line of stitching 196 attaching the heel tape to the heel of the vamp and in overlying relationship to the seam formed by the heel edges.

Figure 28:
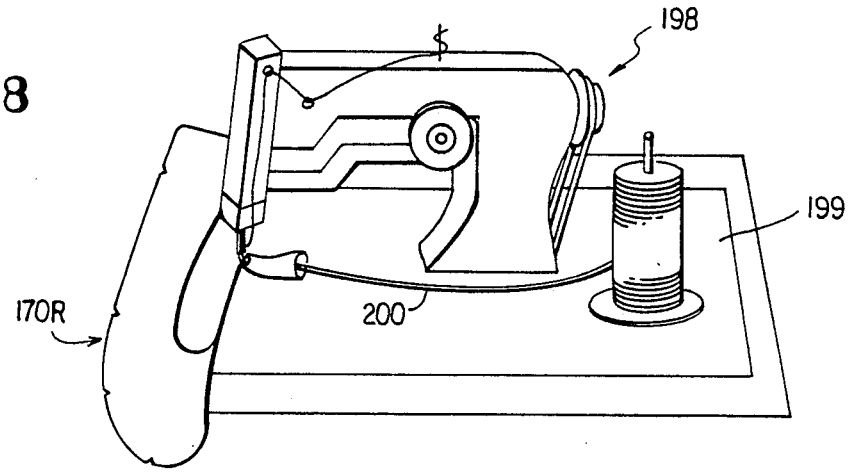
Figure 29:
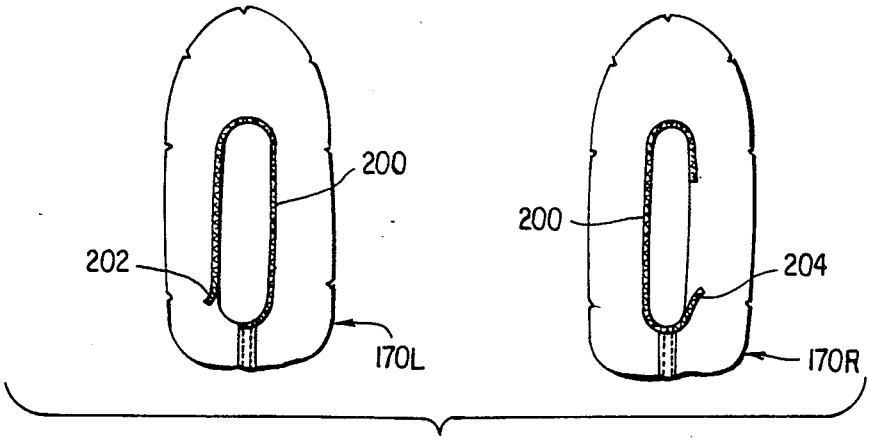

Referring now to FIG. 28 of the drawings, a conventional sewing machine 198 is provided with a supporting surface 199. In this case, a zigzag machine is set up with one needle and is adapted to sew a strip of elastic 200 to the upper edge of the vamp. The vamps are right and left as indicated by reference characters 170R and 170L respectively in FIGS. 29 and 30. The right vamp is placed wrong side up on the machine with the heel toward the operator. As seen in FIG. 29, the left vamp 170L is provided with a tail-off 202, and the right vamp 170 R is provided with a tail-off 204, the tail off in each case being at the heel size notch on the inside of the vamp.

Figure 30:
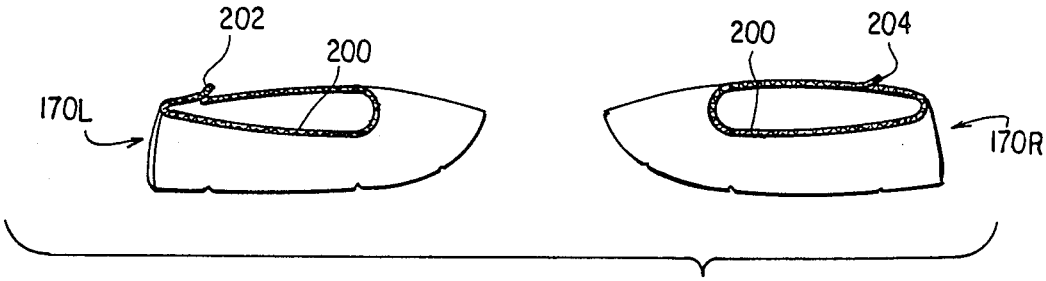

The elastic 200 is sewed to the vamp throat starting directly across from the size notch and is directed toward the heel of the right vamp. The sewing continues around the throat top catching the vamp securely in the elastic. The start point is cut flush with the vamp throat contour. The sewing continues beyond the start point about three-quarter's inch. At this point the operator chains to the left vamp with a three-quarter's inch elastic tail length. The left vamp is then placed wrong side up on the machine with the toe toward the operator. The sewing is directed toward the toe of the left vamp, and the steps described above in connection with the right vamp are repeated. In this manner, as seen in FIG. 30, elastic 200 is applied to the upper edge of the left and right vamps 170L and 170R with tail-offs 202 and 204 being provided respectively. The vamps are then turned right side out.

Figure 31:
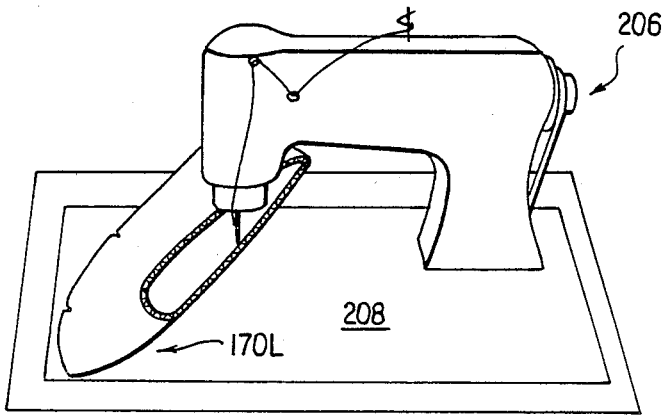
Figure 32:
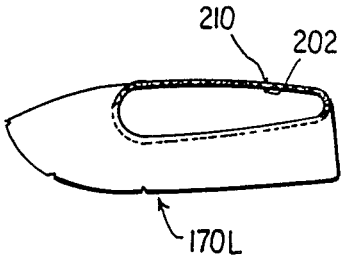

As seen in FIG. 31 of the drawings, a conventional sewing machine 206 is provided with a supporting surface 208. The left vamp 170 L is positioned as shown such that the right side of the vamp is facing the machine feed and the wrong side of the vamp will be facing the machine foot. The elastic is then top stitched to the vamp. Sewing is started at a point 210 as seen in FIG. 32 about one-quarter inch in front of the elastic tail-off 202, turning the elastic down to the inside of the vamp, the tail-off being folded down to the bottom edge of the elastic. The sewing proceeds towards the toe and thence around the vamp top, folding the elastic down as the sewing continues. The sewing continues to the start point and about three-quarters inch beyond the start point and down along the folded down tail off. Tail-off 202 is then cut flush at an angle sloping back toward the heel of the vamp.

The elastic is then top stitched to the right vamp in a similar manner. The difference in the method of topstitching the right vamp is that the sewing is started about one-quarter inch in back of the elastic tail-off 204, the sewing proceeding towards the heel and thence around the vamp and beyond the start point. Tail-off 204 is then cut flush as discussed above.

Referring now to FIG. 33 of the drawings, a conventional tacker machine 214 is shown. The vamp is placed right side up on the machine with the throat center facing the tacker foot. The trim bow 176 is premade and is placed right side up on the topstitch at the vamp throat center with the ends of the bow extending toward the toe. One tack is then sewed in the center of the bow to attach it in place.

Referring now to FIG. 34 of the drawings, a conventional shirr machine 220 is provided with a supporting surface 221. The left vamp is placed right side up on the machine with the toe toward the machine foot. Sewing is started at point 222 as seen in FIG. 35 at the vamp toe notch to the left of the center toe notch and continues to a point 224 at the toe notch to the right of the center toe notch. This shirring gathers the toe portion of the slipper to provide fullness thereat for the receiving a person's toes. The right vamp is shirred in a similar manner.

The outsole 66' is then attached to a portion of the outsole pad in a manner substantially identical to that discussed in connection with FIGS. 9 and 10 of the drawings.

Referring now to FIGS. 36 and 37, the manner of attaching the vamp to the outsole is illustrated. A conventional sewing machine 230 is employed having a supporting surface 232. This machine is a walking machine using a low walking motion. The outsole is placed on the machine with the right side up and the vamp is placed on top of the outsole with the right side down so that the right sides of the outsole and vamp are disposed in facing relationship. The vamp heel tape is then centered on the heel notch of the outsole and the edges are aligned. The heel is then sewed around, and the vamp heel side notch is aligned with the outsole side notch. The edges are aligned, and the sewing is continued toward the toe.

The vamp toe shirring is then centered on the outsole center toe notch, the edges are aligned and the sewing continues around the toe. The sewing continues toward the heel, aligning the notches and edges, the sewing continuing over the start point and about three quarter's inch therebeyond.

The remaining steps of the method of making the ballerina type slipper are substantially identical to those of the method of making the scuff type slipper as discussed in connection with FIGS. 13–19.

The invention has been described with reference to a preferred embodiment. Obviously, modification, alterations and other embodiments will occur to others upon reading and understanding this specification. It is my intention to include all such modifications, alterations and alternate embodiments insofar as they come within the scope of the appended claims or the equivalent thereof.

What is claimed is:

1. The method of making a slipper comprising attaching a portion of an outsole having a right side and a wrong side to a portion of an outsole pad having a right side and a wrong side, attaching a vamp having a right side and a wrong side to said outsole, attaching said outsole to a sock having a right side and a wrong side, turning the outsole pad, vamp and sock to their right sides through an opening in said outsole, and securing a further portion of the outsole to a further portion of the outsole pad to provide a finished slipper.

2. The method as defined in claim 1 wherein the step of attaching said outsole to a sock includes attaching a portion of the outsole to the sock, then pulling another portion of the outsole pad through the opening in said outsole, and subsequently attaching a further portion of the outsole to said sock.

3. The method as defined in claim 1 including the step of attaching the vamp to the sock when attaching the outsole to the sock.

4. The method as defined in claim 1 wherein the wrong side of the outsole pad is disposed in facing relationship to the right side of the outsole before a portion of the outsole is attached to a portion of the outsole pad.

5. The method as defined in claim 1 wherein the outsole is attached to the outsole pad by attaching toe portions thereof to one another.

6. The method as defined in claim 1 wherein the right side of the vamp is disposed in facing relationship to the right side of the outsole before attaching the vamp to the outsole.

7. The method as defined in claim 1 wherein the right side of the sock is disposed in facing relationship to the right side of the outsole before attaching the outsole to a sock.

8. The method as defined in claim 1 including the step of substantially closing said opening and maintaining said opening substantially closed.

9. The method of making a slipper comprising providing an outsole having a right side and a wrong side and an opening formed therethrough, attaching a portion of said outsole to a portion of an outsole pad having a right side and a wrong side, attaching a vamp having a right side and a wrong side to said outsole so that the vamp and outsole are inside out from their position in a finished slipper, attaching said vamp and outsole to a sock having a right side and a wrong side, turning said outsole and vamp through said opening so as to be right side out, and attaching another portion of the outsole pad and the outsole to one another to provide a finished slipper.

10. The method as defined in claim 9 wherein the wrong side of said outsole pad and the right side of said outsole are disposed in facing relationship to one another before attaching said outsole pad to said outsole, and a toe portion of said outsole pad is attached to a toe portion of said outsole.

11. The method as defined in claim 9 wherein the right side of said vamp is disposed in facing relationship to the right side of said outsole before said vamp is attached to said outsole.

12. The method as defined in claim 9 wherein the right side of the sock is disposed in facing relationship to the right side of the outsole and the wrong side of the vamp before the outsole and vamp are attached to the sock, partly attaching the vamp and outsole to the sock, passing the outsole pad through said opening, and then further attaching the vamp and outsole to the sock.

13. The method as defined in claim 9 wherein the opening in the outsole is substantially closed and is maintained substantially closed.

14. The method as defined in claim 13 including the step of attaching a further portion of the outsole to a further portion of the outsole pad.

15. The method of making a slipper comprising forming a vamp having a right side and a wrong side, providing an outsole having a right side and a wrong side and an elongated opening formed therethrough, attaching a toe portion of an outsole pad to a toe portion of said outsole with the outsole pad in covering relationship to and accessible through said opening, attaching said vamp to said outsole with the right side of the vamp facing the right side of the outsole, attaching said outsole and vamp to a sock and passing said outsole pad through said opening, said outsole, outsole pad and sock each having a toe and a heel portion, turning said toe and heel portion through said opening so that the right side of the vamp and the right side of the outsole face away from one another, and further attaching said outsole to said outsole pad.

16. The method as defined in claim 15 wherein said vamp is formed by placing the right side of a vamp in facing relationship to the right side of a vamp lining, attaching portions of the vamp and vamp lining to one another, turning said last-mentioned attached portions inside out, and attaching further portions of the vamp and vamp lining to one another.

17. The method as defined in claim 16 including the step of embroidering said vamp.

18. The method as defined in claim 15 wherein said vamp is formed by providing a vamp having opposite heel edges, folding the vamp so that portion of the right side thereof are disposed in facing relationship, attaching said heel edges to one another to provide attached edges, and subsequently turning said vamp right side out.

19. The method as defined in claim 18 including the step of providing tape over said attached edges.

20. The method as defined in claim 18 wherein the vamp has an upper edge and including the step of applying elastic to said upper edge of the vamp.

21. The method as defined in claim 18 including the step of attaching trim to said vamp.

22. The method as defined in claim 18 wherein the vamp has a toe portion an including the step of shirring said toe portion of the vamp.

* * * * *